US006158195A

United States Patent [19]

Andersson et al.

[11] Patent Number: 6,158,195

[45] **Date of Patent: *Dec. 12, 2000**

[54] PACKAGING MACHINE SYSTEM WITH A MULTI-STAGE VALVE ACTUATOR FOR FILLING PRODUCTS INTO A CONTAINER

[75] Inventors: Sven-Arne Andersson, Buffalo Grove, Ill.; Lars Brunndahl, Lund, Sweden; Arde Kirka, Schaumburg, Ill.; Michael Wagner, Elmhurst, Ill.; Karl G. Axelsson, Dalby, Sweden

[73] Assignee: Tetra Laval Holdings & Finance, SA, Pully, Switzerland

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/866,809

[22] Filed: May 30, 1997

Related U.S. Application Data

[60] Provisional application No. 60/018,663, May 30, 1996.

[51] Int. Cl.[7] ..... B65B 1/04

[52] U.S. Cl. ..... 53/237; 141/9; 141/100

[58] Field of Search ..... 53/237; 141/128, 141/115, 9, 100; 251/339, 319

[56] References Cited

U.S. PATENT DOCUMENTS

| | | | |
|---|---|---|---|
| 3,952,782 | 4/1976 | Mannara | 141/100 |
| 4,211,263 | 7/1980 | Kennedy et al. | 141/83 |
| 4,337,802 | 7/1982 | Kennedy et al. | 141/1 |
| 4,606,174 | 8/1986 | Berg | 53/551 |
| 4,630,654 | 12/1986 | Kennedy, Jr. | 141/83 |
| 5,016,687 | 5/1991 | Kawamura | 141/116 |
| 5,687,779 | 11/1997 | Andersson et al. | 141/9 |

*Primary Examiner*—John Sipos
*Assistant Examiner*—Steven Jensen
*Attorney, Agent, or Firm*—Welsh & Katz, Ltd.

[57] ABSTRACT

A fill system for use in a packaging machine is disclosed for filling a container with a primary and a secondary product. The fill system includes a primary pump system for pumping a predetermined amount of the primary product received at an inlet thereof. A primary fill pipe having an outlet overlying a container processing path along which the containers are filled and sealed by the packaging machine is connected to receive the predetermined amount of primary product from the outlet of the primary pump system. The fill system further includes a secondary pump system for pumping a predetermined amount of the secondary product received at an inlet thereof to an outlet thereof. A secondary fill pipe is connected to receive the predetermined amount of secondary product from the outlet of the secondary pump means. A valve mechanism is disposed, for example, concentrically within the secondary fill pipe and includes a sealing member positioned at the outlet of the secondary fill pipe. The valve mechanism is driven by a linear multi-stage actuator to provide multiple selected valve opening widths.

1 Claim, 8 Drawing Sheets

PACKAGING MACHINE SYSTEM WITH A MULTI-STAGE VALVE ACTUATOR FOR FILLING PRODUCTS INTO A CONTAINER

CROSS-REFERENCE TO RELATED APPLICATIONS

This application claims benefit of priority of provisional application, Ser. No. 60/018,663, filed May 30, 1996.

STATEMENT REGARDING FEDERALLY SPONSORED RESEARCH OR DEVELOPMENT

Not applicable.

BACKGROUND OF THE INVENTION

The present invention relates to a filling system for use in a packaging machine. More particularly, the present invention relates to a filling system which utilizes a multi-stage linear valve actuator to provide for different filling rates and volumes.

In the past, packaging machine systems have been proposed, such as disclosed in International Publication Number WO 96/09957, entitled "Packaging Machine System for Filling Primary and Secondary Products Into A Container," published Apr. 4, 1996. The '957 International Publication claims priority from a U.S. patent application, Ser. No. 08/315,246, filed Sep. 29, 1994 now, U.S. Pat. No. 5,687,779. International Publication No. WO 96/09957 and U.S. Pat. No. 5,687,779 are expressly incorporated herein by reference in their entireties.

A need remains within the industry for an improved product filling mechanism which has enhanced filling accuracy and which is able to fill containers of differing volume sizes.

BRIEF SUMMARY OF THE INVENTION

It is an advantage of the present invention to provide a multi-step secondary outlet valve assembly to improve filling accuracy for containers of differing volumes.

It is a further advantage of the present invention to provide a multi-step secondary outlet valve assembly which provides an even filling profile.

It is yet a further advantage of the present invention to provide a multi-step secondary outlet valve assembly which affords better accuracy when combining two products, such as cream and skim milk, thereby affording a better end product.

These and other advantages of the invention are achieved in a packaging machine for filling a container with a primary product and a secondary product comprising a primary fill pipe having an interior extending to an outlet. The machine also has a secondary fill pipe arranged within the interior of the primary fill pipe. The secondary fill pipe has an opening near the outlet of the primary fill pipe. A multi-stage valve is arranged at the opening of the secondary fill pipe, and a linear valve actuator is operatively connected to the valve to open the valve in multiple discrete stages with respect to the opening of the secondary fill pipe, thereby controlling secondary product flow therethrough.

DETAILED DESCRIPTION OF THE INVENTION

Figure 1:
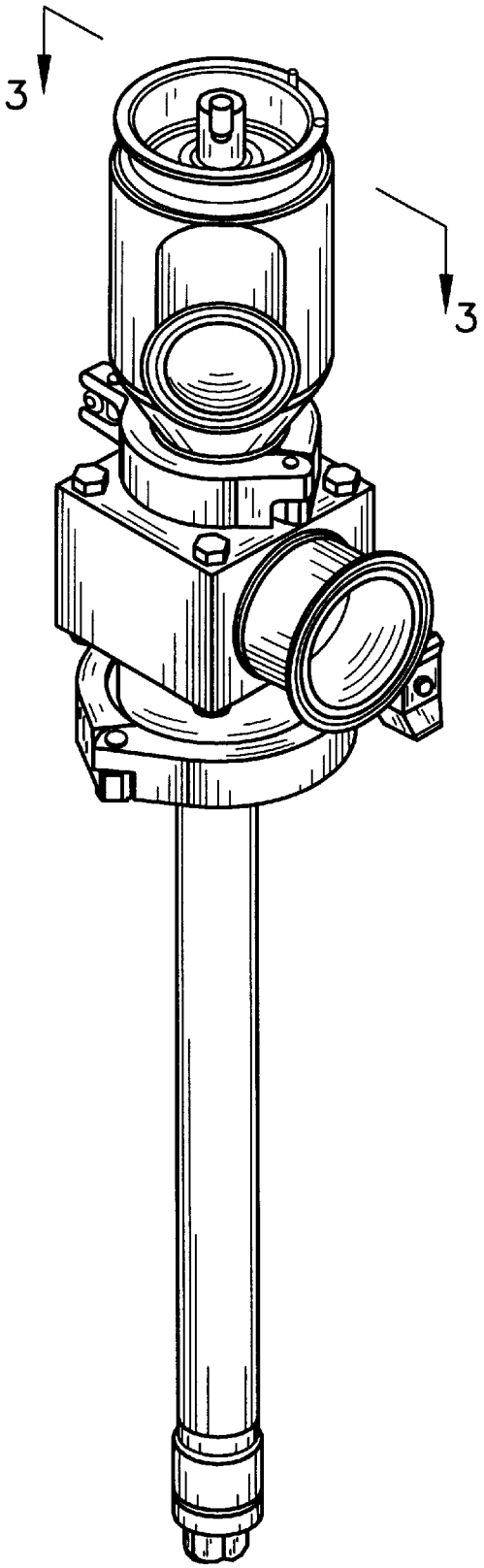
FIG. 1 illustrates a perspective view of a filling mechanism according to the present invention.
Figure 2:
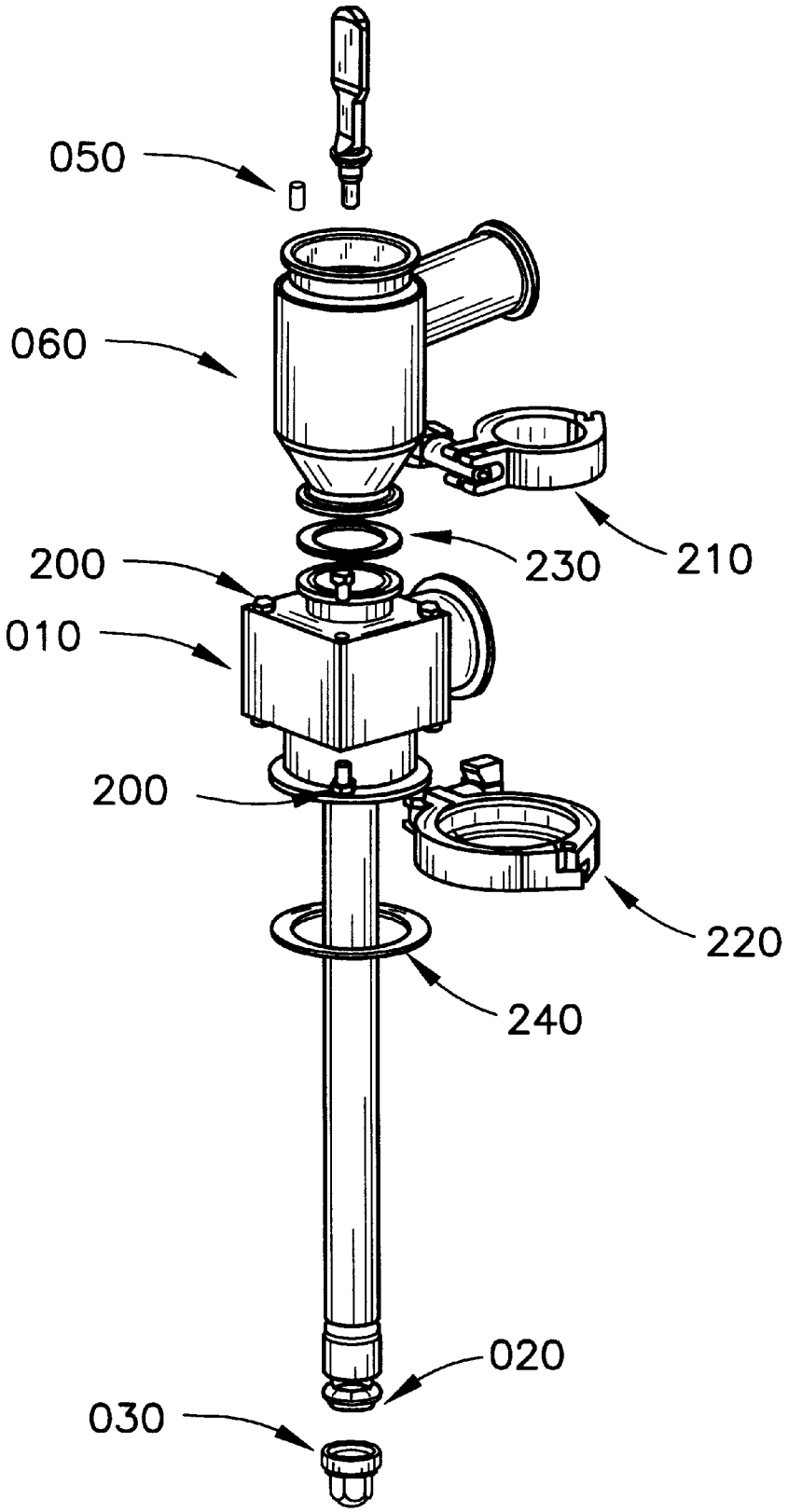
FIG. 2 illustrates a perspective exploded view of a filling mechanism according to the present invention.
Figure 3:
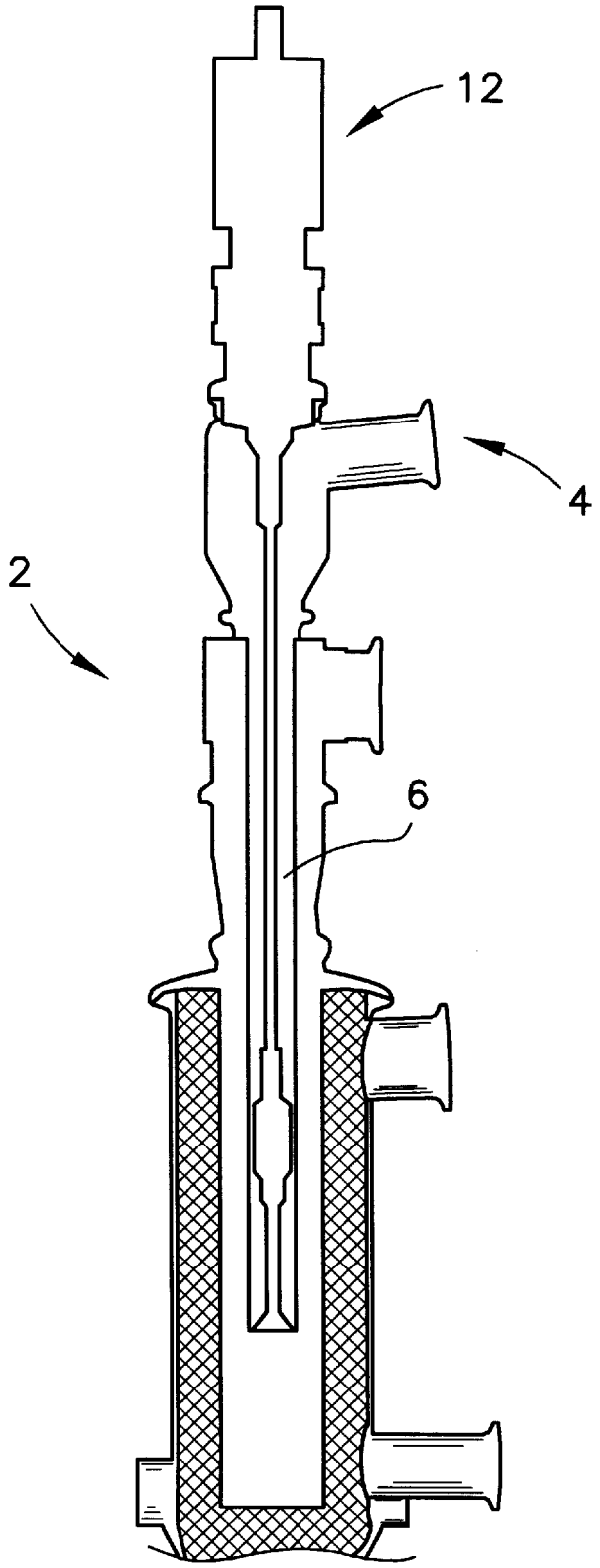
FIG. 3 illustrates a side sectional view of a filling mechanism according to the present invention taken along line 3—3 in FIG. 1.

FIG. 3 generally illustrates a filling mechanism (denoted by the reference numeral 2) according to a preferred embodiment of the present invention. The general structure of the filling mechanism 2 is set forth and described in the above referenced co-pending U.S. application (Ser. No. 08/315,246, filed Sep. 29, 1994) and International Publication (WO 96/09957, published Apr. 4, 1996). Since the '246 U.S. Application and '957 International Publication have been incorporated by reference, the details of the filling mechanism are not described hereafter.

Figure 4A:
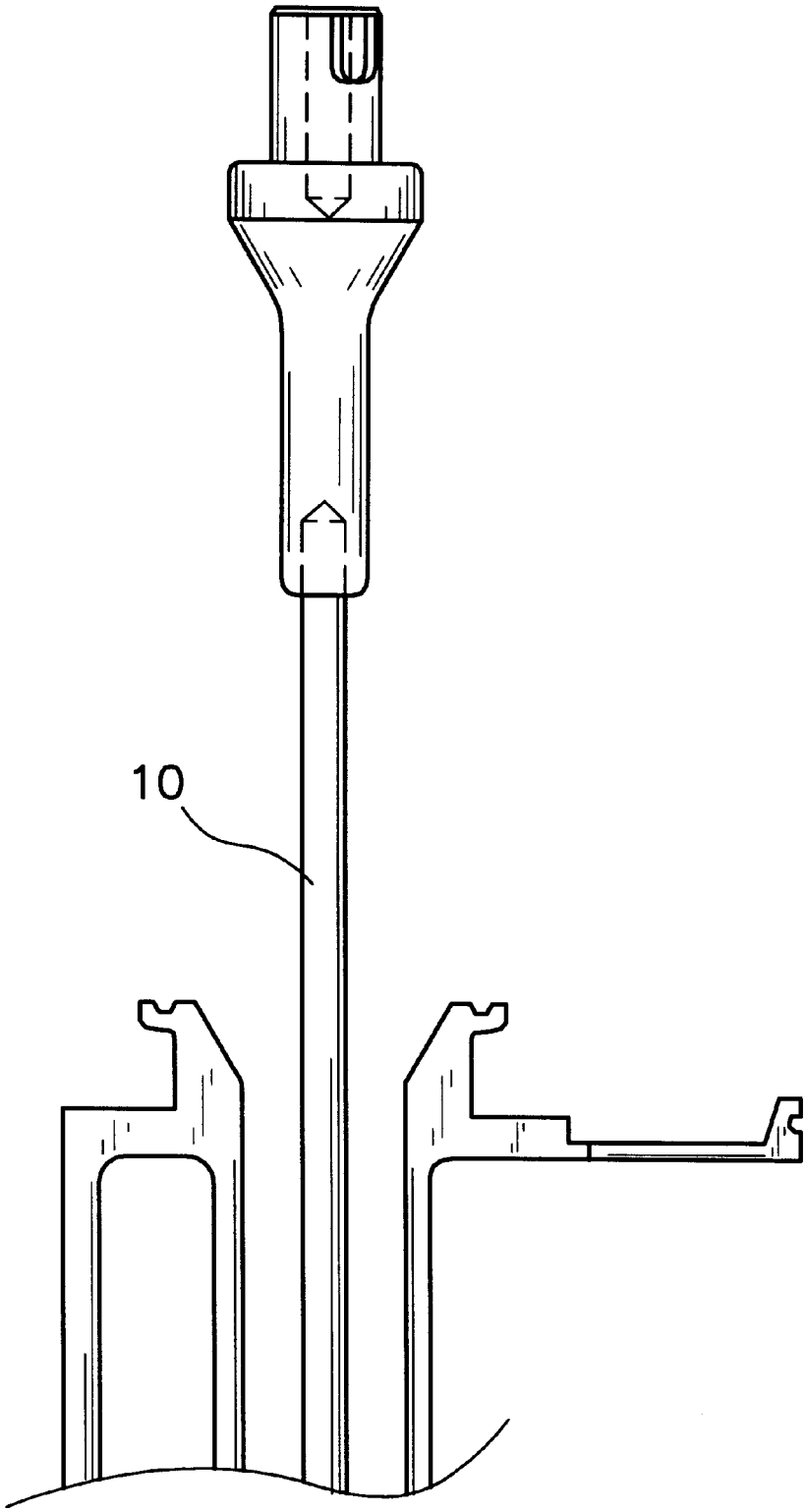
FIG. 4A illustrates a side sectional view of an upper most portion of the filling mechanism of FIG. 3.
Figure 4B:
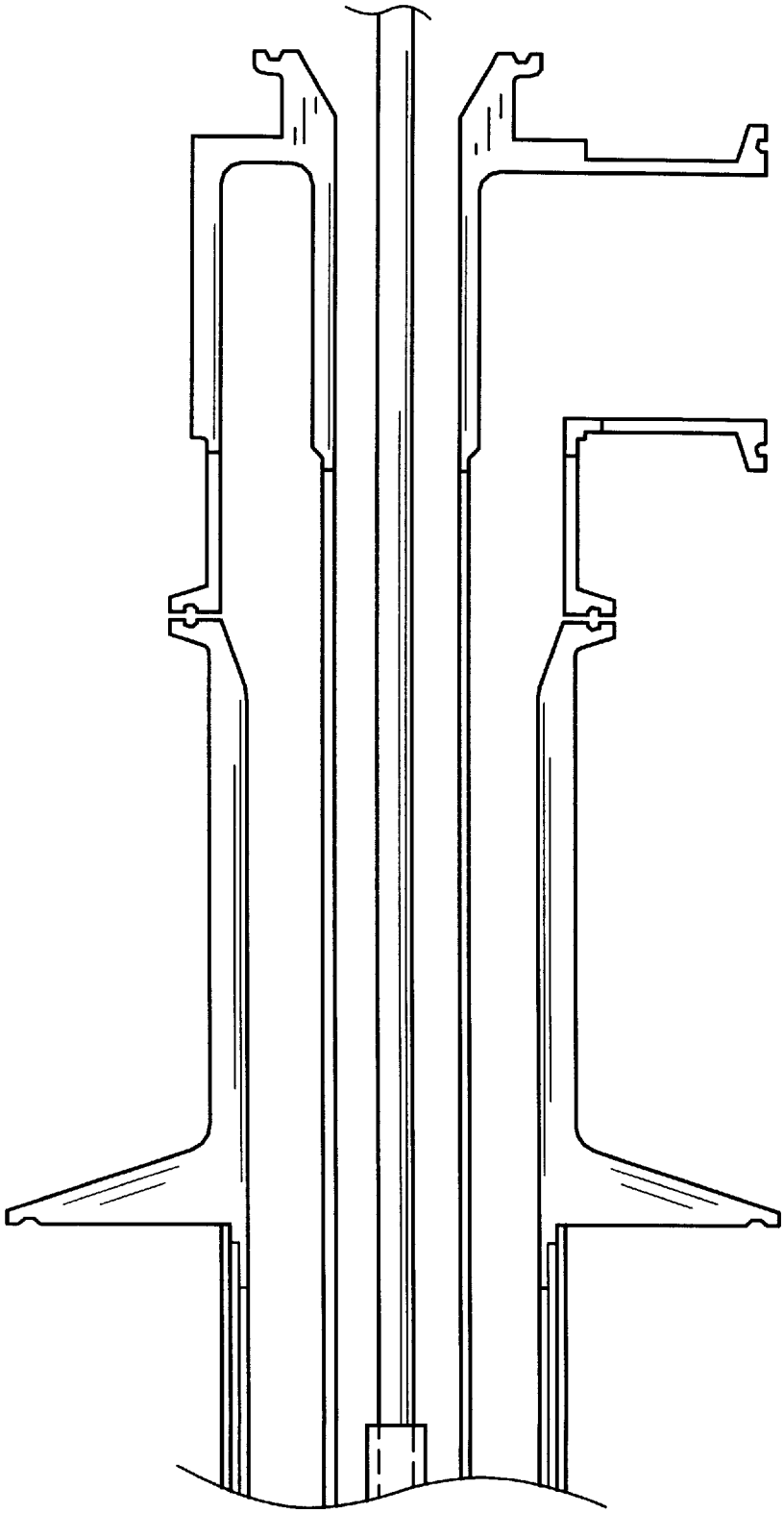
FIG. 4B illustrates a side sectional view of an intermediate section of the filling mechanism of FIG. 3.
Figure 4C:
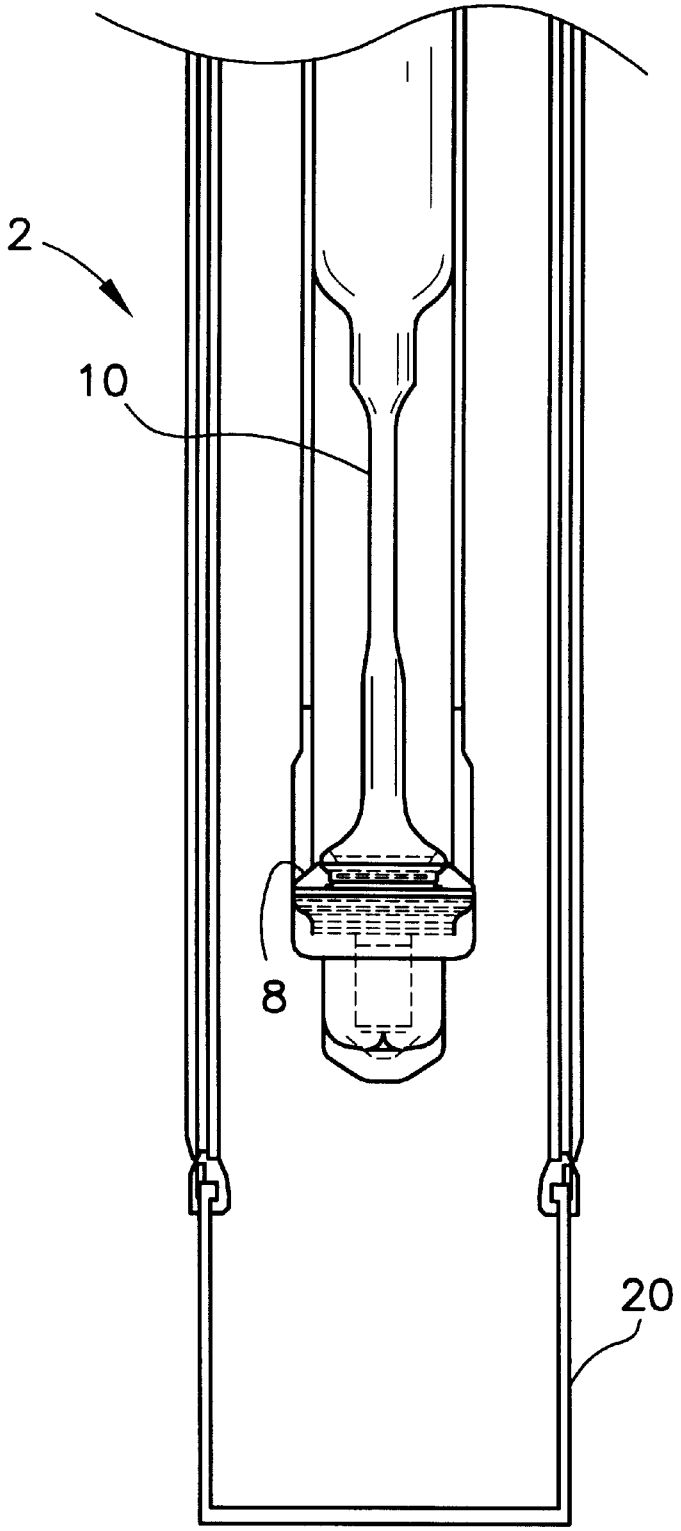
FIG. 4C illustrates a side sectional view of a lower end portion of the filling mechanism of FIG. 3 when in a closed position.

Generally, the filling mechanism includes an inlet 4 for secondary product which communicates with a fill pipe 6. The fill pipe 6 has an open lower end 8 (FIG. 4C). The fill pipe 6 receives a stem 10 along its interior. The upper end of the stem 10 is securely engaged by a linear valve actuator (generally denoted by reference 12 in FIG. 3). The stem 10 is driven linearly and reciprocally along its longitudinal axis by the actuator 12. The linear actuator 12 may be one of several known constructions, such as a mechanically driven actuator, pneumatically driven actuator, hydraulically driven actuator and the like. In the preferred embodiment, the actuator is hydraulically driven. The linear valve actuator 12 may be extended to multiple discrete steps or stages. For instance, the linear valve actuator 12 may represent a two-step/stage actuator which is drivable between a retracted position, a first extended position and a second extended position.

Optionally, the actuator 12 may include more than two steps or stages, depending on the needs of the filling mechanism.

FIG. 4C illustrates a lower end portion of the filling mechanism 2, while the actuator 12 is retracted, whereby the stem 10 sealably closes the open end 8 with the valve 18.

Figure 5:
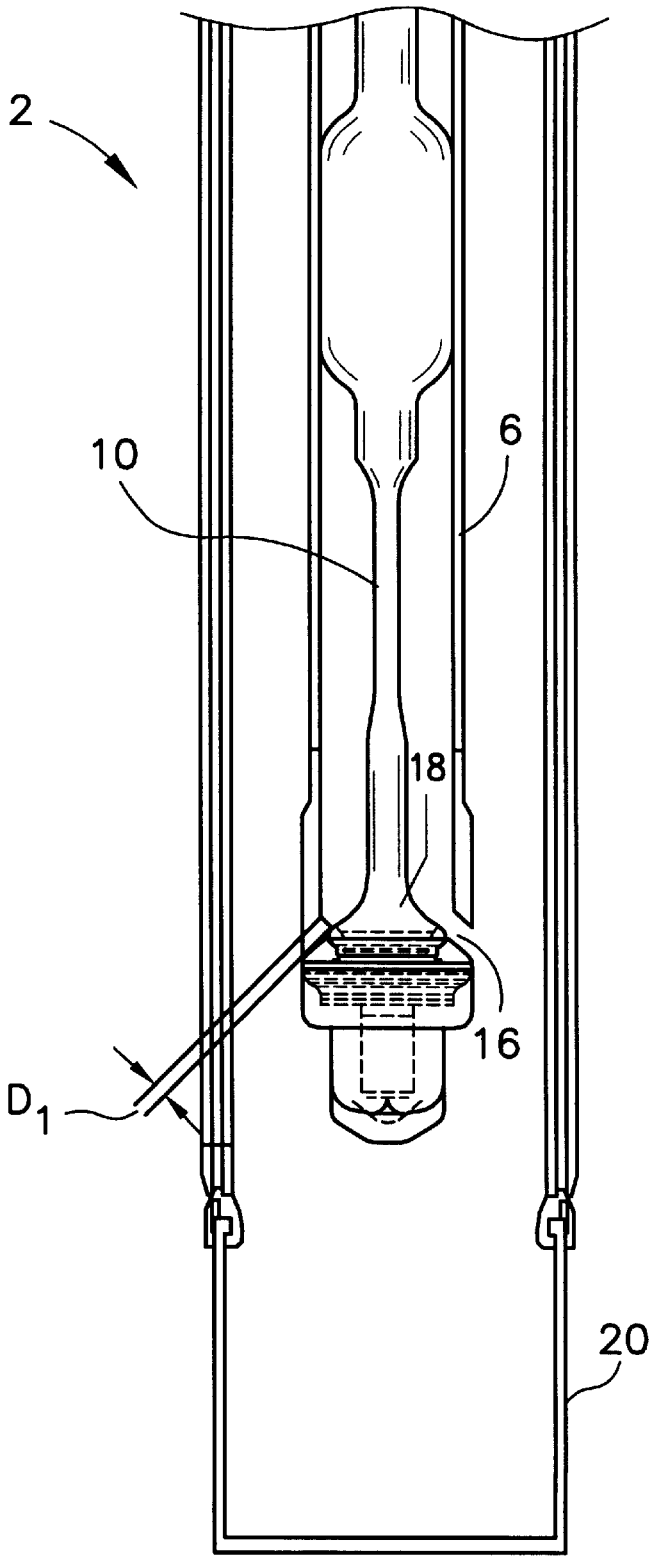
FIG. 5 illustrates a side sectional view of the lower end portion of the filling mechanism of FIG. 3 when opened to a first step or stage.

FIG. 5 illustrates the lower end portion of the filling mechanism 2, while the linear actuator 12 is extended to the first step or stage. When extended to the first step, the actuator 12 drives the stem 10 downward by a first distance or valve stroke to a first position. When at the first extended position, an opening 16 is provided between the valve 18 and the lower end 8 of the fill pipe 6. The width of the opening 16 is denoted $D_1$.

Figure 6:
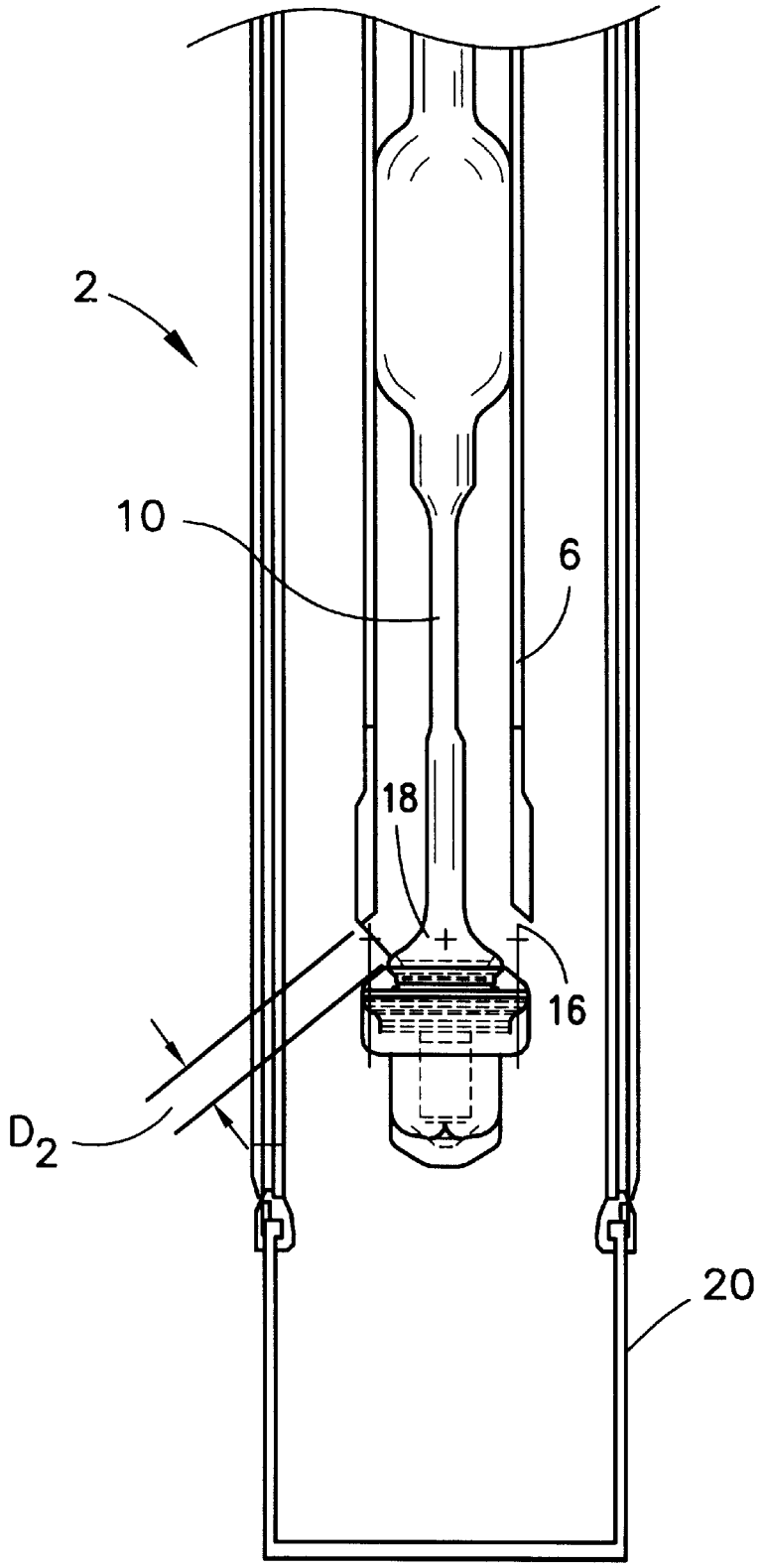
FIG. 6 illustrates a side sectional view of the lower end portion of the filling mechanism of FIG. 3 when opened to a second step or stage.

FIG. 6 illustrate the lowered portion of the filling mechanism 2 while the actuator 12 is extended to the second step or stage. When extended to the second step or stage, the actuator 12 drives the stem 10 downward to a second extended position. When at the second step, the opening 16 is widened to a width denoted $D_2$ filling nozzle 20 is shown at the bottom of the filling mechanism 2 in FIGS. 4C, 5 and 6.

As explained above, the linear actuator 12 may include more than two steps and thus the opening 16 may be discretely varied by distances other than $D_1$ and $D_2$. The gap widths $D_1$ and $D_2$ may vary depending upon the particular application. By way of example only, the width $D_1$ may equal 4 mm while the width $D_2$ may equal 10 mm.

By utilizing a linear actuator 12 which is extendable to multiple steps, the preferred embodiment of the present invention provides more accuracy when filling containers of differing volumes, thereby providing a more even filling profile.

While particular elements, embodiments and applications of the present invention have been shown and described, it will be understood, of course, that the invention is not limited thereto since modifications may be made by those skilled in the art, particularly in light of the foregoing teachings. It is, therefore, contemplated by the appended claims to cover such modifications as incorporate those features which come within the spirit and scope of the invention.

What is claimed is:

1. A fill system in a packaging machine for filling a series of containers with a primary product and a secondary product, the fill system comprising:

a primary fill pipe in flow communication with a primary product, the primary fill pipe, openable to allow the primary product and secondary product to discharge from the fill system; having an outlet overlying a container processing path along which each of the series of containers are filled and sealed on the packaging machine;

a nozzle connected at the outlet of the primary fill pipe;

a secondary fill pipe in flow communication with a secondary product, the secondary fill pipe being concentrically disposed within the primary fill pipe and having an outlet overlying the outlet of the primary fill pipe;

a multi-stage valve arranged at the outlet of the secondary fill pipe, the multi-stage valve operating between an opened position and a sealed position, the multi-stage valve having a diameter greater than a diameter of the outlet of the secondary fill pipe and lesser than a diameter of the outlet of the primary fill pipe; and a linear valve actuator operatively connected to the multi-stage valve to open the multi-stage valve in multiple discrete stages with respect to the outlet of the secondary fill pipe, the linear valve actuator connected to the valve by a stem disposed within the secondary fill pipe;

whereby the flow of the secondary product through the outlet of the secondary fill pipe may be controlled by extension or retraction of the multi-stage valve between the opened and sealed positions and secondary product mixes with the primary product prior to flowing through the nozzle.

* * * * *